US007628583B2

(12) United States Patent
Roberts et al.

(10) Patent No.: US 7,628,583 B2
(45) **Date of Patent: *Dec. 8, 2009**

(54) DISCRETE PASSAGE DIFFUSER

(75) Inventors: Douglas Allan Roberts, Cambridge (CA); André Denis LeBlanc, St-Bruno (CA); Suresh Chandra Kacker, Oakville (CA); Peter Ralph Townsend, Mississauga (CA); Ioan Sasu, Brossard (CA)

(73) Assignee: Pratt & Whitney Canada Corp., Longueuill (CA)

( * ) Notice: Subject to any disclaimer, the term of this patent is extended or adjusted under 35 U.S.C. 154(b) by 133 days.

This patent is subject to a terminal disclaimer.

(21) Appl. No.: 10/983,085

(22) Filed: Nov. 8, 2004

(65) Prior Publication Data

US 2005/0118019 A1 Jun. 2, 2005

Related U.S. Application Data

(63) Continuation of application No. PCT/CA03/00526, filed on Apr. 10, 2003.

(51) Int. Cl.
*F01D 9/04* (2006.01)
*F04D 29/44* (2006.01)

(52) U.S. Cl. ..... 415/208.3; 415/211.2; 415/224.5

(58) Field of Classification Search ..... 415/208.2, 415/208.3, 211.1, 211.2, 224.5
See application file for complete search history.

(56) References Cited

U.S. PATENT DOCUMENTS

| | | | | | |
|---|---|---|---|---|---|
| 1,662,249 | A | * | 3/1928 | Jennings | 415/224.5 |
| 3,333,762 | A | * | 8/1967 | Vrana | 415/208.3 |
| 3,420,435 | A | * | 1/1969 | Jarosz et. al. | 415/208.3 |
| 3,832,089 | A | * | 8/1974 | Moellmann | 415/211.1 |
| 3,964,837 | A | * | 6/1976 | Exley | 415/208.3 |
| 4,212,585 | A | * | 7/1980 | Swarden et al. | 415/58.6 |
| 4,576,550 | A | | 3/1986 | Bryans | |
| 5,252,027 | A | * | 10/1993 | Brasz | 415/224.5 |
| 5,372,477 | A | * | 12/1994 | Cole | 415/218.1 |
| 5,478,200 | A | * | 12/1995 | Brodersen et al. | 415/206 |
| 5,564,898 | A | * | 10/1996 | Richards et al. | 415/211.2 |
| 6,166,462 | A | * | 12/2000 | Finkenbinder et al. | 415/211.2 |
| 6,220,816 | B1 | * | 4/2001 | Nguyen et al. | 415/208.2 |
| 6,471,475 | B1 | * | 10/2002 | Sasu et al. | 415/211.2 |
| 6,589,015 | B1 | * | 7/2003 | Roberts et al. | 415/208.3 |

FOREIGN PATENT DOCUMENTS

| | | |
|---|---|---|
| FR | 1 603 204 | 3/1971 |
| GB | 170 815 | 10/1921 |
| JP | 01-257797 | 10/1989 |
| WO | WO - 02 06676 | 1/2002 |
| WO | WO-02/06676 A1 * | 1/2002 |

* cited by examiner

*Primary Examiner*—Christopher Verdier
(74) *Attorney, Agent, or Firm*—Ogilvy Renault LLP

(57) ABSTRACT

A centrifugal compressor includes an impeller and a diffuser, the diffuser having a plurality of descrete D-shaped passages intersecting each other.

14 Claims, 4 Drawing Sheets

DISCRETE PASSAGE DIFFUSER

RELATED APPLICATIONS

This is a continuation of International Patent Application No. PCT/CA03/00526 filed Apr. 10, 2003, the content of which is incorporated herein by reference.

TECHNICAL FIELD

The present invention relates generally to centrifugal compressors, and in particular, to a diffuser for a centrifugal compressor.

BACKGROUND OF THE INVENTION

Centrifugal compressors have a wide variety of industrial and aeronautical applications, including gas turbine engines, fluid pumps and air compressors. Centrifugal compressors generally consist of at least two main components: an impeller and a diffuser.

Pipe diffusers, generally having circumferentially spaced frustro-conical discrete passages, are commonly used to perform these functions. Typically, the radially extending passages are angled from the radial direction such that their center lines are all tangent to a single tangency circle. A partially vaneless space is therefore created where the passages intersect, between the tangency circle and an outer leading edge circle. The intersection of circular pipe diffuser passages creates symmetrically located elliptical leading edge ridges formed on the leading edge circle. When such a diffuser is placed around an impeller, the exit flow from the impeller will enter the diffuser at the tangency circle, flow through the partially vaneless space, and enter the discrete passages of the diffuser.

One cause of centrifugal compressor pressure losses, which negatively affect the compressor efficiency and therefore the overall compressor aerodynamic performance, is any mismatch between the impeller exit flow angles and the inlet angles of the diffuser. As the distribution of the impeller fluid exit angles from the impeller hub to the shroud end of the impeller vanes is not uniform, it follows that ideally the leading edges of the diffuser passages would be shaped to provide a corresponding profile of inlet angles. Traditionally used diffuser pipes having a circular cross-section form generally oval diffuser passage leading edges, which fail to provide such an ideal match with the impeller fluid exit angles.

SUMMARY OF THE INVENTION

It is an object of the present invention to provide a diffuser capable of improving compressor efficiency.

It is a further object of the present invention to provide an improved incidence match between the impeller exit air angles and the diffuser leading edge angles.

Therefore, in accordance with the present invention, there is provided a centrifugal compressor including an impeller and a diffuser, the impeller having an inner integral hub with vanes thereon, being adapted to rotate within an outer shroud about a central longitudinal axis, and having a defined hub-to-shroud distribution of fluid exit angles, the diffuser, being downstream from the impeller, comprising: a plurality of circumferentially spaced discrete passages at least partially defining fluid paths through the diffuser, and being angled such that adjacent discrete passages intersect each other to form an annular semi-vaneless diffuser inlet space; the discrete passages downstream of the semi-vaneless space each having an inlet therefrom and an outlet with a greater cross-sectional area than the inlet; intersection of the annular semi-vaneless space and each discrete passage defining a leading edge thereof; each discrete passage being defined by a wall bounding a cross-sectional area, the wall comprising at least a first substantially rectilinear portion and a second opposed convexly curved portion; the first substantially rectilinear portion being adjacent the hub of the impeller and the second opposed convexly curved portion being adjacent the outer shroud; and the leading edge of each discrete diffuser passage providing a close incidence angle match with the fluid exit angles of the impeller.

There is also provided, in accordance with the present invention, a diffuser for use with an upstream impeller in a centrifugal compressor, comprising: a plurality of circumferentially spaced discrete passages defined by walls bounding cross-sectional areas, the walls at the inlets of the passages comprising at least a first substantially rectilinear portion and a second opposed convexly curved portion; adjacent discrete passages intersecting each other at their respective inlets to form an annular semi-vaneless space at an inlet of the diffuser; intersection of the annular semi-vaneless space and the discrete passages defining swept back leading edges thereof, providing a close incidence angle match with a hub-to-shroud distribution of fluid exit angles from the impeller.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1:
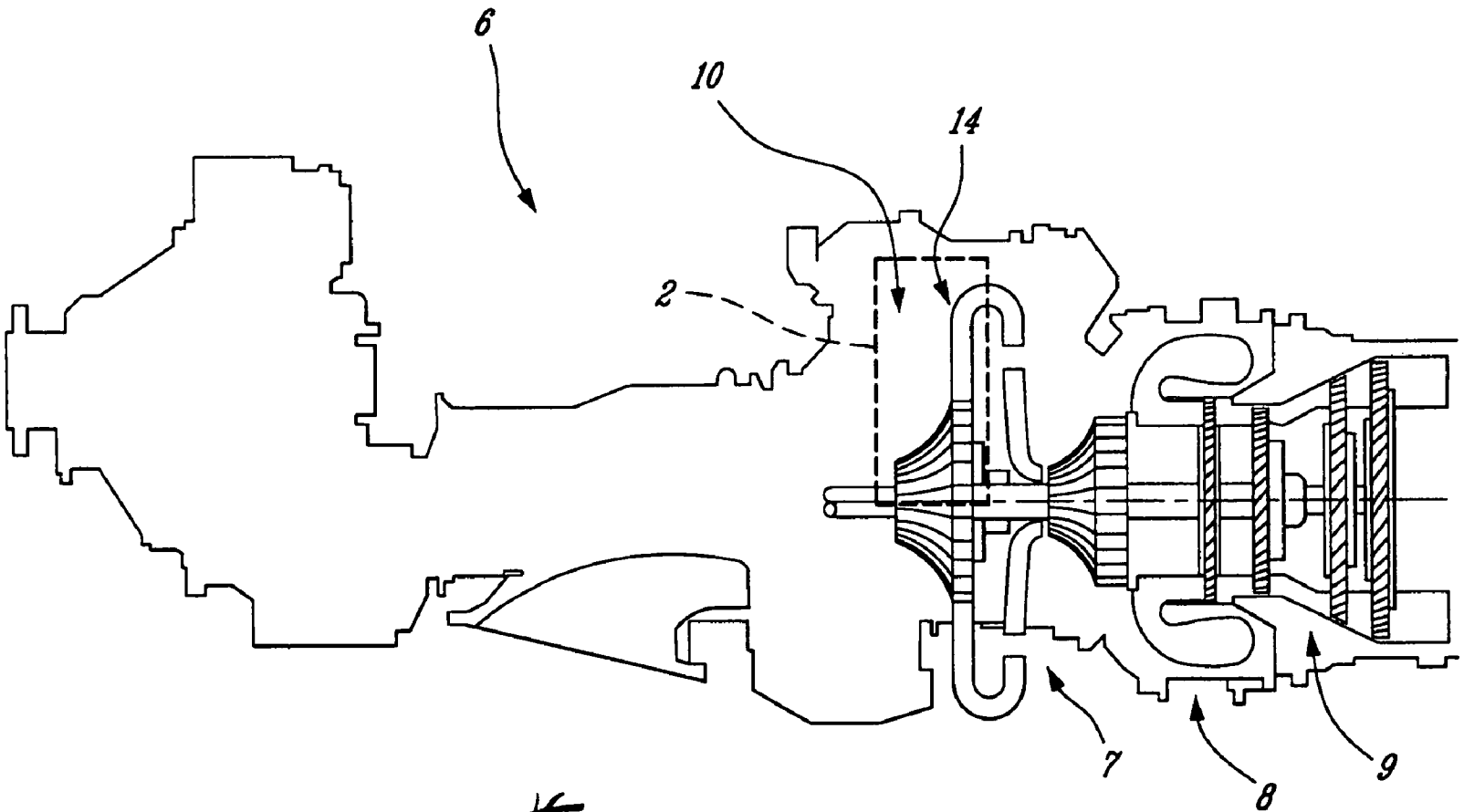
FIG. 1 is a partial cut-away view of a gas turbine engine having a centrifugal compressor and the diffuser of the present invention.

Referring to FIG. 1 showing a generic gas turbine engine 6, one application of the present invention, having generally at least a compressor portion 7, a combustion portion 8, and a turbine portion 9. The compressor portion 7 includes at least a centrifugal compressor assembly 10. The gas turbine engine can comprise a turboprop, turbofan or turboshaft engine. While such a gas turbine engine is shown and represents one possible application for a diffuser 14 of the present invention, such a diffuser is equally applicable in any other application having a centrifugal compressor, including but not limited to automotive turbochargers, air conditioning compressors and the like.

Figure 2:
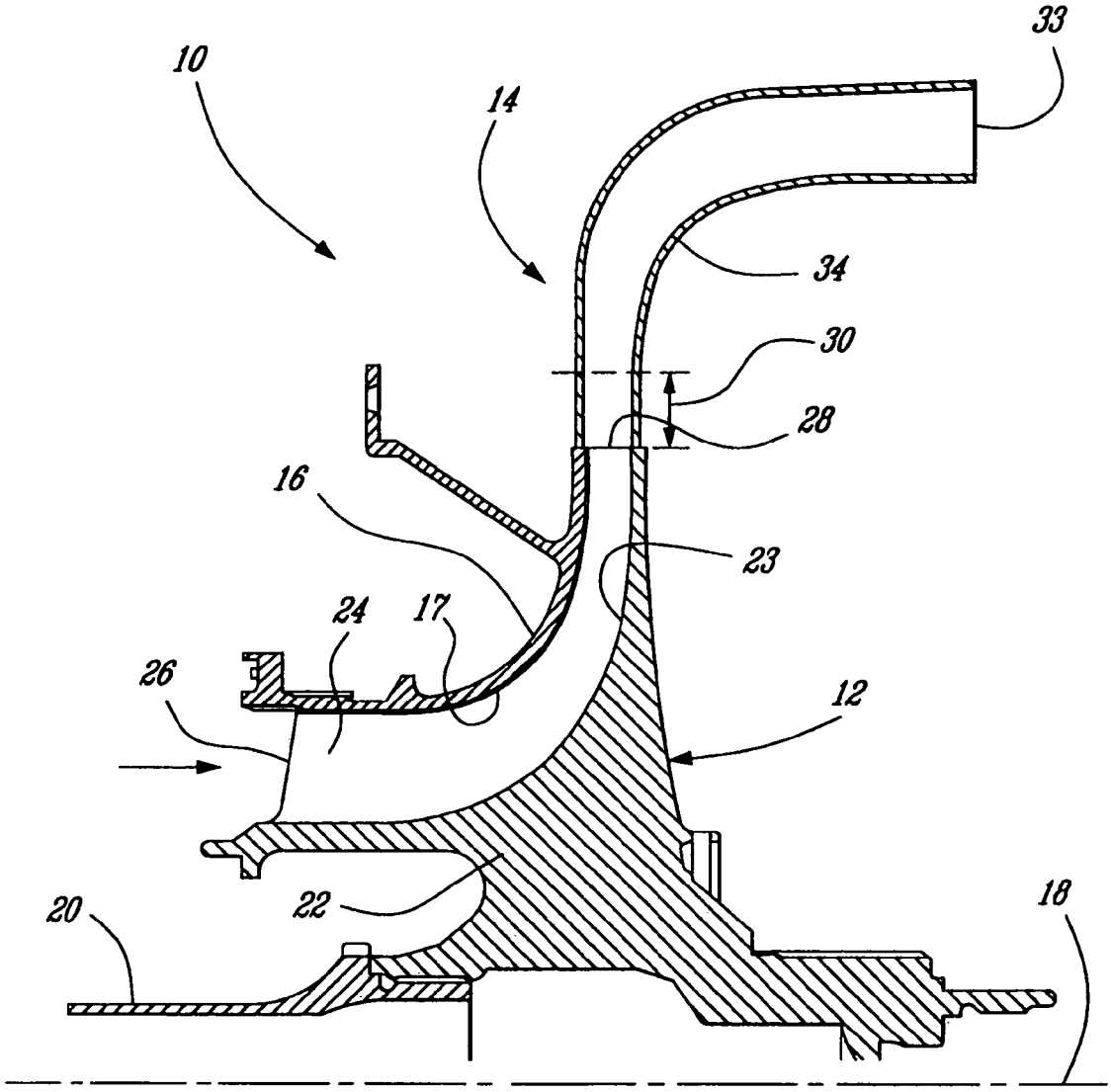
FIG. 2 is an enlarged axial cross-sectional view of the centrifugal compressor and diffuser of the present invention taken from detail 2 of FIG. 1.

Referring now to FIG. 2, the centrifugal compressor assembly 10 comprises generally an impeller 12 and the diffuser 14. The impeller 12, fixed to a central shaft 20, rotates about a central axis 18 within a stationary impeller shroud 16. The impeller 12 comprises a central hub portion 22 and a plurality of vanes 24 at the radial periphery of the impeller. The impeller vanes 24 redirect the fluid flow by ninety degrees, forcing the flow radially out from the axial inlet, and increase the velocity of the fluid flow. Fluid enters the impeller 12 at leading edges 26 of the impeller vanes 24. The annular fluid path through the impeller 12 is defined by the circumferential outer shroud 16, and the curved outer surface 23 of the impeller hub 22.

Fluid leaving the impeller vanes at their exit 28, enters the substantially vaneless inlet space 30 of the diffuser 14. This semi-vaneless diffuser inlet space 30 will be described in further detail below. The diffuser is generally comprised of a plurality of discrete diffuser passages 34, located at regular intervals circumferentially about an annular diffuser case 36, shown in FIG. 4*a* and described in further detail below, surrounding the impeller exit 28. The working fluid flows through the diffuser passages 34, being turned back through ninety degrees and expanded, converting the high velocity of the flow into high static pressure. The diffuser passages 34 also deswirl the fluid exiting the impeller. Fluid then exits the diffuser at the downstream ends 33 of the diffuser passages 34.

Figure 3:
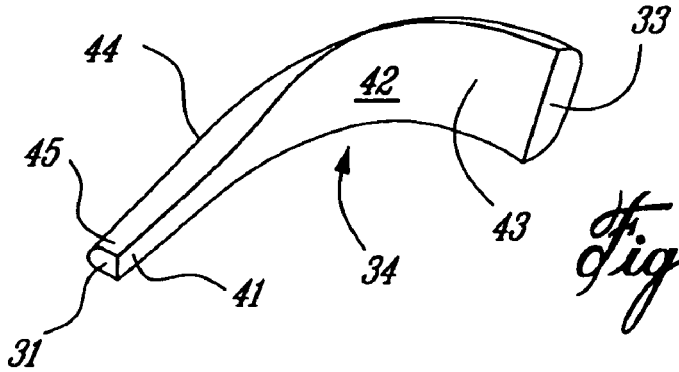
FIG. 3 is a perspective view of a discrete diffuser passage of the diffuser of FIG. 2.

Referring to FIG. 3, each discrete diffuser passage 34 has a substantially D-shaped cross-section throughout, comprising an arcuate surface 44 and an opposing substantially flat surface 42. At the upstream end 41, the surface 42 is truly flat, lying on a surface of revolution formed about the central axis 18 of the impeller 12. However, at the downstream end 43, the surface 42 is slightly curved, as a result of the transition of the diffuser passage from a radial inlet flow to an axial outlet flow. The arcuate surface 44 and the opposing substantially flat surface 42 are preferably connected by flat sides 45, which smoothly blend into the arcuate surface 44, and are generally close to perpendicular to the flat surface 42 at the downstream end 41 thereof. Preferably, however, the flat sides 45 are approximately about 80 degrees from the flat surface 42 at the downstream end of the diffuser passage 34, as this improves manufacturability. The length of the flat sides 45 and the radius of the arcuate surface 44 can be varied by one skilled in the art as required to best conform to the specific impeller vane exit configuration.

Figure 4A:
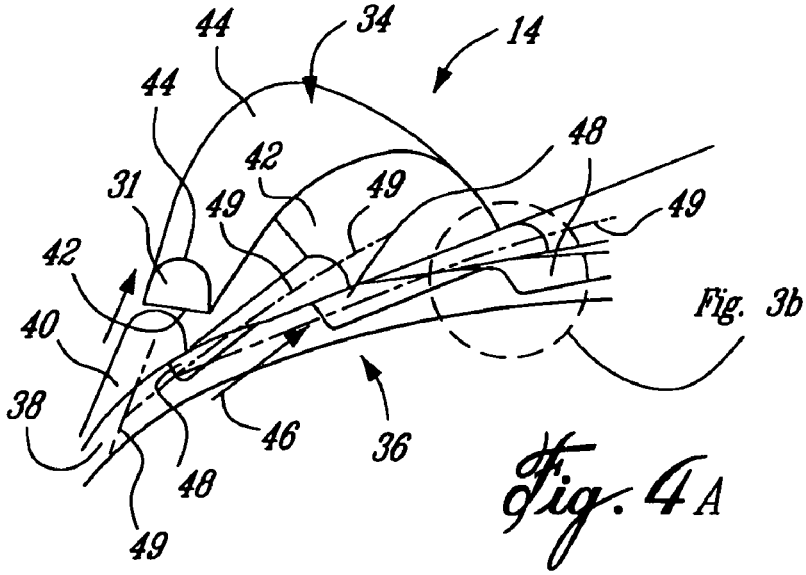
FIG. 4*a* is an exploded, partial perspective view of the diffuser of FIG. 2.
Figure 4B:
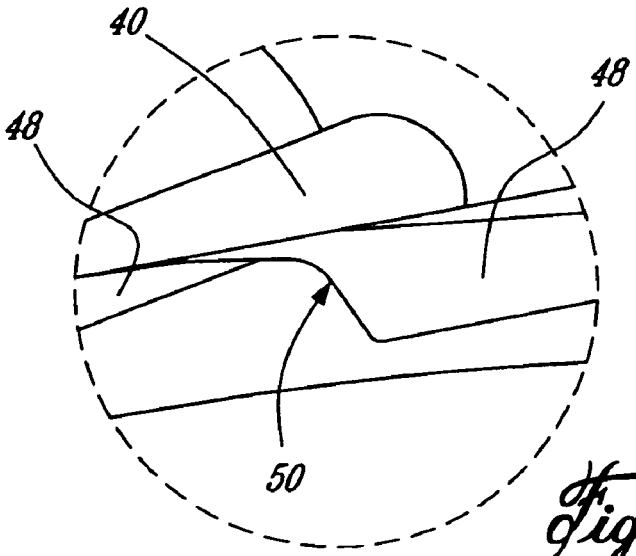
FIG. 4*b* is a detailed view from FIG. 3*a* of the leading edges of the discrete diffuser passages of the diffuser of FIG. 2.
Figure 5:
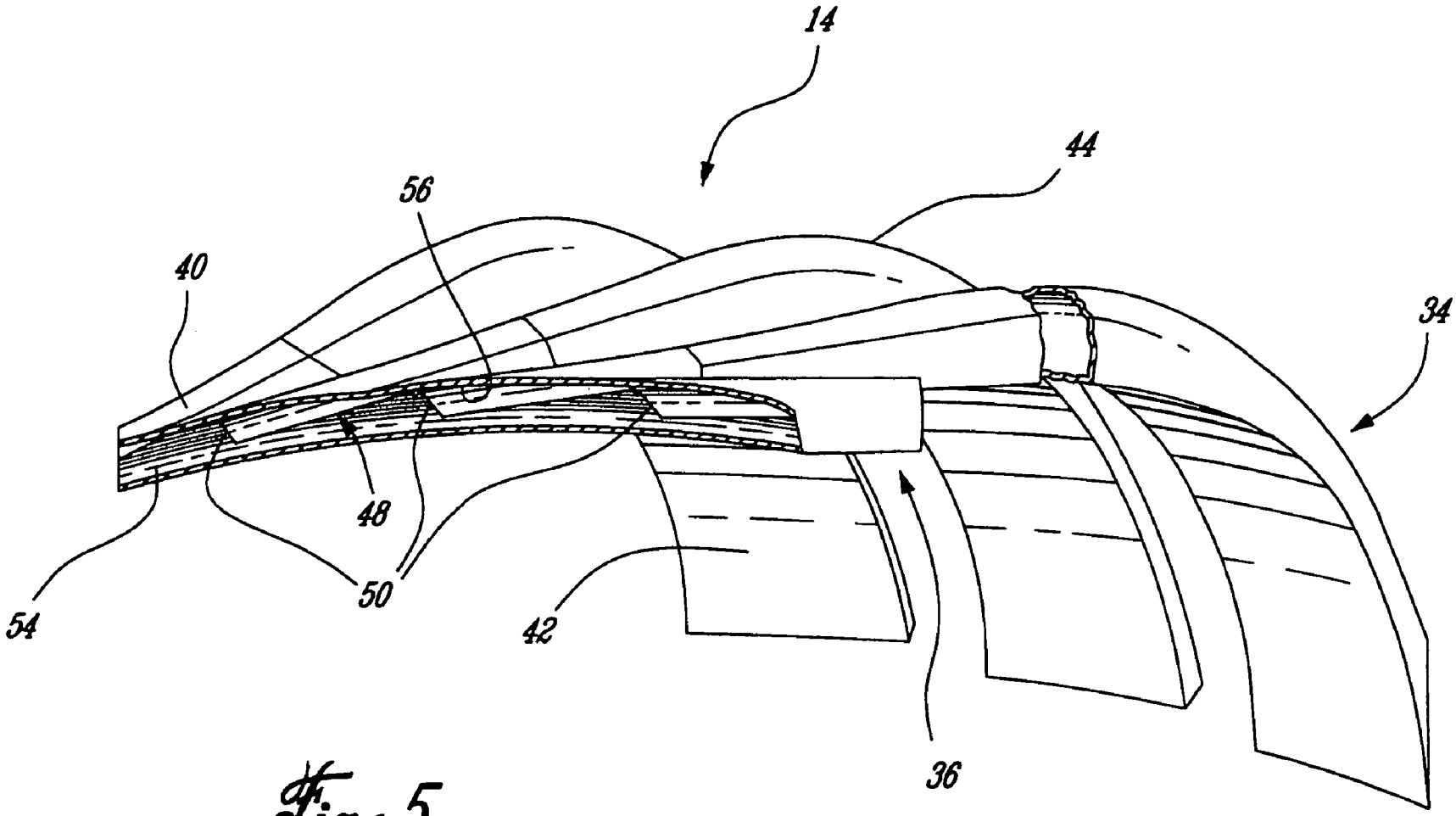
FIG. 5 is a fragmentary perspective view of the diffuser of FIG. 2.

Referring to FIG. 4*a*, 4*b*, and 5, the discrete diffuser passages 34 are engaged to the annular diffuser case 36, which circumscribes the impeller exit 28. Although it is not essential, the diffuser case 36 is preferably a unitary machined part, having an arcuate inner surface 38 and a plurality of discrete diffuser passage inlet portions 40 formed at repeated angular intervals about the circumference of the diffuser case 36. Each diffuser passage inlet portion 40 comprises a machined slot 48 therethrough, formed to correspond to the shape of the discrete diffuser passages 34, and are therefore substantially D-shaped in cross-sectional shape. Each D-shaped slot 48 in the diffuser case 36, and therefore each corresponding D-shaped inlet 31 of the discrete diffuser passages 34, are oriented such that the arcuate portion of the slot corresponds to the impeller shroud side of the impeller exit 28 and the flat portion of the slot corresponds to the impeller hub side of the impeller exit. The flat portion 56 of each slot abuts the flat surface 42 of the corresponding D-shaped inlet 31 of the diffuser passages 34, and accordingly, the arcuate portion 54 of each slot 48 abuts the arcuate surface 44 of the inlet portion of the corresponding diffuser passage.

The diffuser passage inlet portions 40 are all identically angled from the radial direction such that their central axes 49 are tangent to a common tangent circle formed about the central axis 18 of the impeller. Adjacent D-shaped slots 48 therefore intersect in the body of the diffuser case 36, forming specially shaped diffuser passage leading edges 50 in the diffuser case inner surface 38. The leading edges 50 are generally swept back, being partially shaped like ogee curves, having a slightly S shaped double curve comprising opposing concave and convex curved ends and a relatively straight central edge portion. These leading edges 50 define a leading edge circle, concentric with the tangent circle, but radially outward therefrom. The outer leading edge circle and the inner tangent circle generally define the annular semi-vaneless space 30. The swirling fluid flow exiting the impeller is aligned in the semi-vaneless space, before entering the discrete diffuser passages 34 in the direction of arrow 46.

Enhanced compressor efficiency is achievable with this design, and results largely from a close match between the diffuser leading edge angles and the hub-to-shroud distribution of the impeller exit fluid angles, as a result of the geometry and orientation of the intersecting D-shaped diffuser passages. Impeller outlet fluid flow near the shroud has a relatively small radial velocity component and a large tangential velocity component. Therefore a curved diffuser passage at the shroud side of the impeller exit more closely matches the fluid exit angles in this region. However, a diffuser leading edge that has a relatively flat angle at the hub side of the inlet, best matches the impeller outlet fluid angles at the hub. Flow coming from the impeller has a gradient in the radial velocity component from shroud to mid channel. In other words, flow angle begins as near tangential at the shroud and reaches a maximum value near the center of the passage, axially approximately half way between the shroud and the hub. From the passage mid point to the hub, the fluid flow angle tends to be relatively constant. Therefore, a leading edge with a flatter angle near the hub is preferable. The closer the match between these angles, the maximum amount of energy, imparted by the impeller, is retained by the fluid flow, and subsequently the better the overall efficiency of the compressor.

While the semi-vaneless space 30 is somewhat similar in construction to vaneless spaces formed by the circular passages of conventional pipe diffusers of the prior art, the intersection of the specific D-shaped passages of the present invention form a unique semi- vaneless space geometry. A cusp, or partial vane, is formed on the impeller shroud by the intersection of she D-shaped passages. This partial vane extends to she impeller exit, and has a varying metal angle, becoming substantially tangential and having very little height at the junction with the impeller. The varying metal angles of the partial vanes therefore closely match the variation in the impeller exit flow between the shroud and the hub, as described above. Adjacent partial vanes in the semi-vaneless space 30 define generally wedge shape passages which help guide the flow into the diffuser. These partial vanes define the beginning of the D-shaped slots 48 of the discrete diffuser passages 34, and generally have a height that varies from a minimum adjacent the impeller exit to a maximum adjacent the fluid path inlet. Thus, these partial vanes extend forwardly towards the exit of the impeller, and have a height which decreases towards the impeller exit. The swept back leading edges 50, as described in more detail above, of the slots 48 and therefore the partial vanes, also provide aerodynamic advantages for supersonic flow. Supersonic shock losses are reduced by the oblique incidence formed by the closely spaced partial vanes of the semi-vaneless space 30.

In conjunction with the diffuser leading edge shape described above, the semi-vaneless space contributes to achieve reduced aerodynamic pressure losses, improved centrifugal compressor efficiency and a wider range of compressor operability.

While the geometry and orientation of the D-shaped discrete passages of the present diffuser provide aerodynamic advantages, other factors become important to consider when evaluating the viability of any new design. Improvements in one criteria often come at the expense of others, and aerodynamic performance is no exception, as such issues as cost efficiency and ease of manufacture can occasionally reduce the overall benefit reaped from an aerodynamic performance improvement.

While the present diffuser does provide aerodynamic advantages, it nevertheless remains cheaper and easier to manufacture. Traditional diffuser cases of the prior art having circular diffuser pipe passages often have to be manufactured by gun drilling, in order to create the intersecting, circumferentially spaced, diffuser passages. As the discrete slots of the present diffuser case are not circular, they can be machined from the side, for example using a milling machine. This permits a part manufacturing process that is less complex and less costly.

The invention claimed is:

1. A centrifugal compressor comprising:

an impeller having a hub mounted for rotation about a compressor central axis within an outer shroud, the impeller having an impeller exit; and a diffuser mounted downstream of the impeller exit, the diffuser having a plurality of circumferentially-spaced discrete passages at least partially defining fluid paths therethrough, each path having an inlet and an outlet, the discrete passages being angled relative to one another such that adjacent discrete passages intersect each other to form an annular semi-vaneless diffuser inlet space upstream of the fluid path inlets, each discrete passage having a substantially D-shaped cross-section extending between said inlet and said outlet, the D-shaped cross-section being composed of a U-shaped arcuate surface opposing a substantially flat surface, the substantially flat surface being adjacent to the hub of the impeller and extending substantially radially from the hub at an inlet of each said passage, the U-shaped arcuate surface being adjacent to the outer shroud of the impeller at the inlet of the passage and facing axially rearward towards the substantially flat surface, the intersection of adjacent D-shaped passages in the semi-vaneless space forming partial vanes on the shroud side of the diffuser by the intersection of the arcuate portions of the passages, and wherein the intersection of the discrete passages creates a leading edge having a repeated pattern of swept back portions, each portion having an S-shaped double curve comprising opposing convex and concave curved ends and a substantially straight central edge portion.

2. The centrifugal compressor as defined in claim 1, wherein the partial vanes extend from the impeller exit to the fluid path inlets.

3. The centrifugal compressor as defined in claim 1, wherein the partial vanes are substantially tangential to an impeller circumference at the impeller exit.

4. The centrifugal compressor as defined in claim 1, wherein each of the partial vanes has a height, the height varying from a minimum adjacent the impeller exit to a maximum adjacent the fluid path inlet.

5. The centrifugal compressor as defined in claim 1, wherein the discrete passages are angled at their inlets relative to a compressor radial direction such that a central axis of each discrete passage is substantially tangential to a common circle formed about the compressor central axis.

6. The centrifugal compressor as defined in claim 1, wherein adjacent partial vanes define therebetween generally wedge shape passages adapted to guide air into the fluid paths.

7. A centrifugal compressor comprising:

an impeller having a hub mounted for rotation about a compressor central axis within an outer shroud; and a diffuser mounted downstream from the impeller, the diffuser having a plurality of circumferentially-spaced discrete passages having a D-shaped cross-section, the D-shaped cross-section defined by an arcuate surface adjacent a shroud side of the diffuser and a substantially flat surface disposed adjacent a hub side of the diffuser, the adjacent discrete passages intersecting each other at their respective inlets to form leading edges of the passages, the leading edge of each passage being swept back and having a slightly S-shaped double curve comprising opposing convex and concave curved ends and a relatively straight central edge portion.

8. The centrifugal compressor as defined in claim 7, wherein the discrete passages are angled at their inlets relative to a compressor radial direction such that a central axis of each discrete passage is substantially tangential to a common circle formed about the compressor central axis.

9. The centrifugal compressor as defined in claim 8, wherein the leading edge generally defines a leading edge circle which is concentric with the common circle and radially outward from the common circle.

10. A centrifugal compressor comprising:

an impeller having a hub mounted for rotation about a compressor central axis within an outer shroud; and a diffuser mounted downstream of the impeller, the diffuser having a plurality of circumferentially spaced discrete passages at least partially defining fluid paths through the diffuser each having an inlet and an outlet, the passages shaped with a substantially D-shaped cross-section having an arcuate surface opposing a substantially flat surface, the arcuate surface disposed adjacent a shroud side of the diffuser and the substantially flat surface disposed adjacent a hub side of the diffuser, the substantially flat surface being a surface of revolution formed about the compressor central axis of the impeller at an upstream end of the discrete passages, the arcuate surface and substantially flat surface being connected by two generally flat sides which smoothly blend into the arcuate surface, the discrete passages being angled relative to one another such that adjacent discrete passages intersect each other to form an annular semi-vaneless diffuser inlet space and defining leading edges of the discrete passages, the leading edge of each said discrete passage being swept back and having a slightly S-shaped double curve comprising opposing convex and concave curved ends and a relatively straight central edge portion.

11. The centrifugal compressor as defined in claim 10, the semi-vaneless space includes a plurality of partial vanes formed on the outer shroud by intersection of the arcuate portions of adjacent D-shaped passages.

12. The centrifugal compressor as defined in claim 11, wherein the partial vanes extend forwardly towards an exit of the impeller, and the partial vanes have a height which decreases towards the impeller exit.

13. The centrifugal compressor as defined in claim 11, wherein the partial vanes extend forwardly to an exit of the impeller, and are substantially tangential to an impeller circumference at the impeller exit.

14. The centrifugal compressor as defined in claim 10, wherein adjacent partial vanes define therebetween generally wedge shape passages adapted to guide air into the discrete passages.

* * * * *